United States Patent [19]

Unsworth et al.

[11] 4,173,469

[45] Nov. 6, 1979

[54] MAGNESIUM ALLOYS

[75] Inventors: William Unsworth, Aspull; John F. King, Bury; Stephen L. Bradshaw, Bolton, all of England

[73] Assignee: Magnesium Elektron Limited, Swinton, England

[21] Appl. No.: 844,939

[22] Filed: Oct. 25, 1977

Related U.S. Application Data

[63] Continuation-in-part of Ser. No. 645,225, Dec. 29, 1977, abandoned.

[30] Foreign Application Priority Data

Dec. 30, 1974 [GB] United Kingdom ..... 56021/74

[51] Int. Cl.[2] ..... C22C 23/00

[52] U.S. Cl. ..... 75/168 F; 75/168 E; 75/168 J; 148/32.5; 148/161

[58] Field of Search ..... 75/168 R, 168 E, 168 F, 75/168 J; 148/161, 32.5

[56] References Cited

U.S. PATENT DOCUMENTS 3,039,868 6/1962 Payne et al. ..... 75/168 J

*Primary Examiner*—M. J. Andrews
*Attorney, Agent, or Firm*—Karl W. Flocks

[57] ABSTRACT

Magnesium alloys having favorable tensile properties contain silver, copper and neodymium. The alloys are subjected to a solution heat treatment followed by ageing to give optimum properties.

7 Claims, 1 Drawing Figure

VARIATION OF STRESS WITH Ag AND Cu CONTENTS

VARIATION OF STRESS WITH Ag AND Cu CONTENTS

MAGNESIUM ALLOYS

Figure 1:
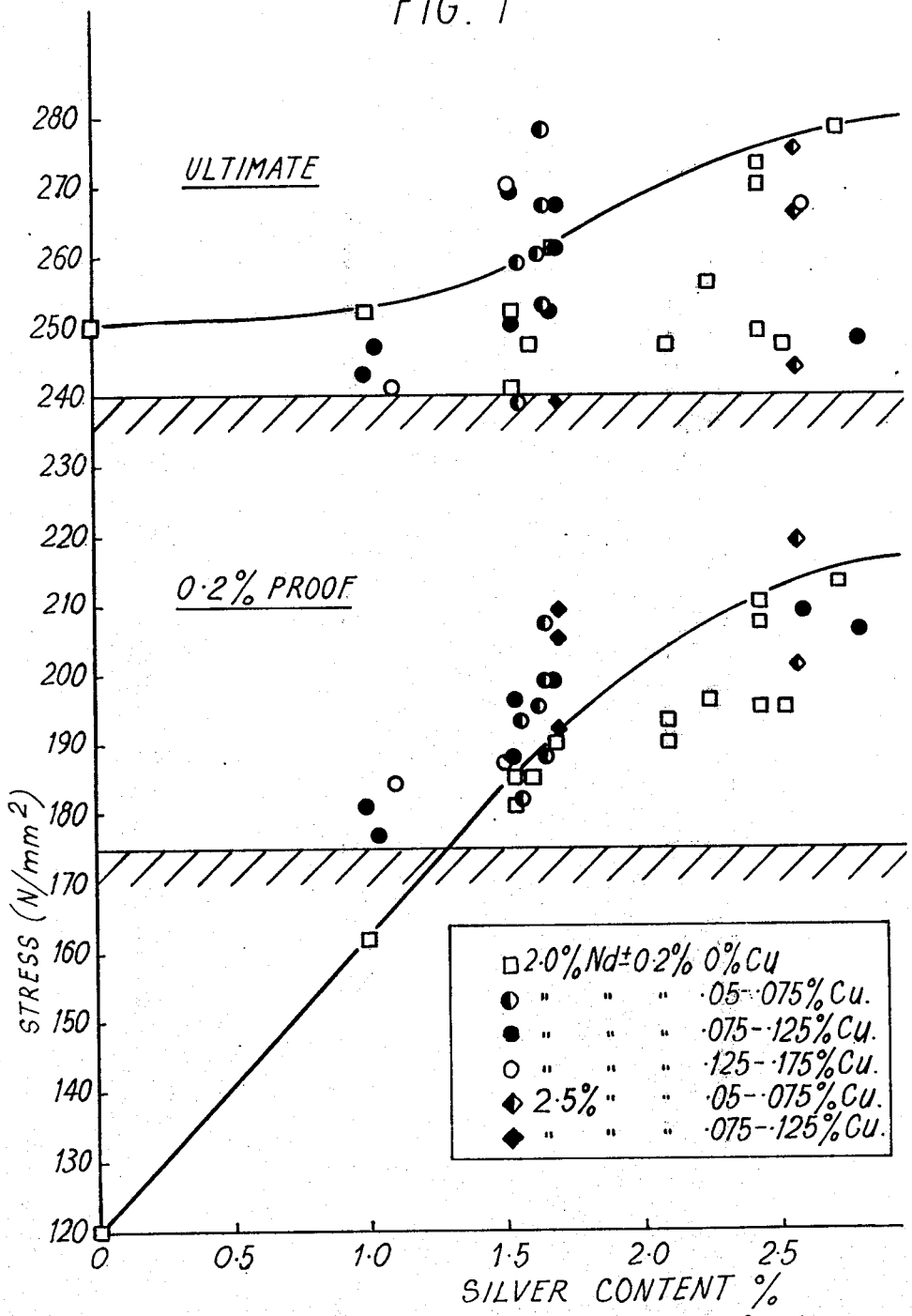

This application is a continuation-in-part of patent application Ser. No. 645,225 filed Dec. 29, 1977, now abandoned.

This invention relates to magnesium base alloys.

Magnesium alloys have a very low weight in comparison with alloys of other metals and accordingly find applications, particularly in the aerospace industry, where a low weight is important. Existing magnesium alloys having advantageous mechanical properties, in particular a high proof stress, are described in U.S. Pat. No. 3,039,868.

These alloys depend largely for their mechanical properties on the presence of a considerable proportion of silver, which is typically present in an amount from 2 to 3% by weight. This makes the alloy very expensive. Moreover the market price of silver is liable to fluctuate violently for reasons associated with its use as a currency and as the cost of the silver presents a major part of the cost of the alloy the latter also fluctuates.

Another disadvantage of these alloys is that the corrosion rate on exposure of sea water increases markedly with an increasing content of silver.

In these alloys the mechanical properties improve with an increasing content of silver and it has been necessary to incorporate above 2% by weight of silver to obtain optimum mechanical properties in the alloys.

In U.S. Pat. No. ,3,039,868 it is implied that the presence of copper is generally undesirable although in suitable circumstances it may be tolerated in small amounts, e.g. up to 0.25% by weight. In fact the presence of even small amounts of copper produces a large drop in the solidus temperature and as the cast alloys have to be subjected to a high-temperature heat treatment to obtain optimum mechanical properties the risk of local melting during heat treatment is increased when copper is present. If an amount of copper approaching 0.25% is added incipient melting is observed, producing cracking in the alloy and rendering the cast useless.

It has now been discovered that small amounts of copper can be added to these alloys without destroying their capacity for heat-treatment and that the addition of copper to these alloys containing not more than 2% silver has a notable effect in improving their tensile properties: in particular, the addition of copper allows ultimate tensile strengths and proof strengths to be obtained equivalent to those obtained with 3% silver but no copper.

According to one aspect of the invention there is provided a cast magnesium base alloy capable of having a 0.2% proof stress of at least 175 N/mm2 and an ultimate tensile strength of at least 240 N/mm2 at ambient room temperature, consisting of the following other than iron and other impurities:

| | |
|---|---|
| Magnesium | at least 88% |
| Silver | from 1 to 2% by weight |
| Copper | from 0.05 to 0.15% by weight |
| Rare Earth Metals of which at least 60% by weight are Neodymium | from 0.5 to 3.0% by weight |
| Zirconium | nil to 1% by weight |
| Manganese | nil to 2% by weight |
| Zinc | nil to 0.5% by weight |
| Cadmium | nil to 1.0% by weight |
| Lithium | nil to 6.0% by weight |
| Calcium | nil to 0.8% by weight |

-continued

| | |
|---|---|
| Gallium | nil to 2.0% by weight |
| Indium | nil to 2.0% by weight |
| Thallium | nil to 5.0% by weight |
| Lead | nil to 1.0% by weight |
| Bismuth | nil to 1.0% by weight |

the maximum quantities of zirconium and manganese being limited by the quantity of the other.

In a preferred embodiment of the invention content of silver is from 1 to 1.75% by weight.

Neodymium, being a rare earth metal, is an expensive material in the pure state but it may conveniently be added in the form of a mixture of rare earth metals. The mixture contains at least 60% by weight of neodymium and not more than 25% by weight of lanthanum and cerium together. Such mixtures are currently available commercially. It should be noted that yttrium is not a "rare earth metal".

Zirconium may be present in the alloy in an amount of up to 1% by weight for grain refining purposes. It is desirable to incorporate at least 0.4% zirconium by weight to obtain satisfactory castings. It is possible to replace part of the zirconium with manganese, but the content of manganese is limited by its mutual solubility with zirconium.

Other elements soluble in magnesium may be present provided that they do not, by forming compounds, interfere with the beneficial effects of the other alloy constituents. Thus, zinc, cadmium, lithium, calcium, gallium, indium, thallium, lead and bismuth may be present in the above-mentioned proportions.

Heat treatment is required in order to develop the optimum mechanical properties for the alloys of the invention. This treatment normally comprises solution heat treatment at an elevated temperature followed by quenching and ageing at a lower temperature. The higher temperature solution treatment is designed to give the maximum practical solubility of the alloying elements such as silver, neodymium and copper; the rapid quench maintains these elements in solution and the ageing allows the required degree of precipitation hardening to occur. It has been found that a temperature of at least 520° C. is required for the higher temperature solution treatment; the upper limit on the solution treatment temperature is the solidus of the alloy. A high temperature treatment time of at least 2 hours is generally required.

Ageing may be carried out at a temperature from 100° C. to 275° C. for a period of at least ½ an hour, longer times being required for lower temperatures in this range. Typical heat-treatment conditions are holding for 8 hours at 520–525° C. for slution treatment, quenching and then holding for 16 hours at 200° C. for precipitation treatment.

The above-mentioned treatment conditions are suitable for alloys containing up to 0.1% by weight copper. When the copper content exceeds this amount a copper-rich eutectic may be formed having a lower melting point and melting of this phase during the solution treatment can cause cracking during subsequent quenching. In order to prevent incipient melting of this copper-rich phase the solution treatment can be initially carried out at a lower temperature, advantageously from 400° to 485° C., followed by solution treatment at 485° C. or above. The initial lower temperatures solution treatment may be carried out for at least one hour. Typical treatment conditions for an alloy containing 0.1–0.15% copper are 16 hours at 465° C. followed by 8 hours at 520° C., quenching and precipitation treatment for 16 hours at 200° C. This modified heat treatment can of course be used with alloys containing less than 0.1% copper if desired.

It has been found that with a copper content exceeding 0.15% quench cracking is obtained even if initial heat treatment is carried out at 400°–485° C. as described above. Such quench cracking renders a casting quite useless. The maximum content of copper if the alloy is to be heat-treated satisfactorily is thus 0.15%.

Research on the structure and properties of magnesium alloys containing silver, copper and rare earth metals additions has been carried out by the inventors and the results are set out below.

(a) The ageing behaviour and structure of simple magnesium alloys containing up to 3% silver and up to 3.5% rare earth metals (not including yttrium or thorium but including at least 60% by weight of neodymium), but no copper, was investigated. It was found that on ageing the cast alloys first intermediate and then equilibrium precipitates are formed from the supersaturated solution obtained on casting.

(b) The mode of precipitation for alloys containing less than 2% silver was different from those containing above 2% silver. The former show a precipitation sequence which gives an equilibrium precipitate of BCT structure (sequence A); the latter show a totally different sequence (sequence B) which produces different intermediates and gives an equilibrium precipitate having a lathe-like structure and believed to have a formula $Mg_{12}(Nd_2Ag)$? Sequences (A) and (B) are as follows:

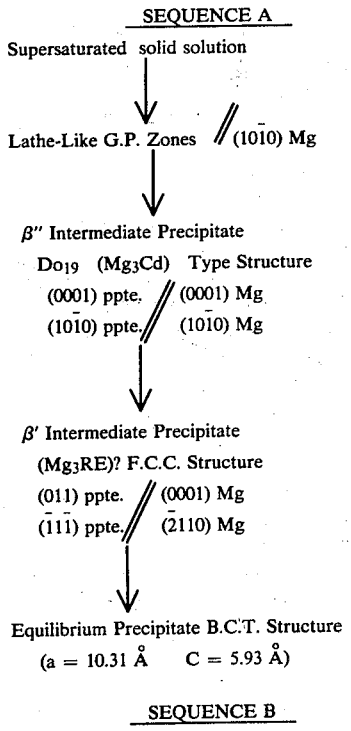

-continued

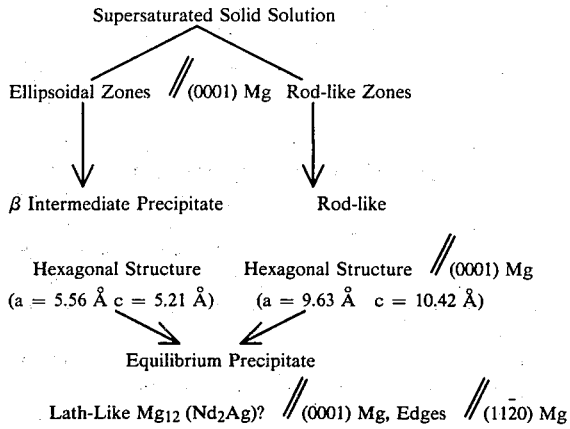

(c) It was found that alloys which showed ageing sequence B having significantly higher mechanical properties, especially yield strengths, after heat treatment, than those showing sequence A.

(d) When amounts of copper from 0.05% to 0.15% were added to the alloys, the alloys exhibited sequence B even when the amount of silver was reduced to 1%.

Particular alloys according to the invention will be described by way of illustration in the following Examples.

EXAMPLES

Alloys having the composition given below were prepared by melting magnesium under a conventional flux, raising its temperature to 800° C., adding all alloy materials, puddling the melt and casting the melt into specimens of suitable shape and size at 780° C. The specimens were heat treated as shown below.

The mechanical properties of the alloy specimens were measured at ambient temperatures in accordance with British Standard 18 and at elevated temperatures in accordance with British Standard 3688. In tests at 200° or 250° C. a soak time of 15 minutes or 1 hour was used.

Corrosion resistance of the samples was tested by the Royal Aircraft Establishment sea water spray test in which samples are exposed but sheltered from precipitation and sprayed 3 times per working day with natural sea water over a period of 2 months. The weight losses were determined and the average corrosion rate calculated.

The castability of the alloys was measured by casting plates 18 mm thick with and without chilling along the extreme edge, machining the plates on both faces and radiographing the plates.

the results of the room temperature mechanical tests are shown in FIG. 1, which is a graph of ultimate tensile stress and 0.2% proof stress, measured at room temperature, against silver content for magnesium alloys containing 2.0 to 2.5% of neodymium and 0.6% of zirconium. The points marked with different symbols relate to alloys containing different amounts of copper; the points indicated by open squares relate to "control" alloys containing no copper and are given for comparison.

It will be seen that in alloys containing above 2.0% of silver the presence of copper has a marginal effect on the mechanical properties. However with a silver range from 1.0 to 2.0% the addition of copper has a considerable effect such that both ultimate and 0.2% proof stress for alloys containing from 1.5% to 1.75% silver are substantially the same as for alloys containing up to 3% silver. The desirable minimum 0.2% proof stress for alloys of this type is 175 N/mm2 and it can be seen from FIG. 1 that, whereas an alloy containing 1% of silver and no copper has a value well below this Figure, addition of copper gives values above this figure. The copper-containing alloys also give ultimate tensile stress above 240 N/mm2 which is the desirable minimum for these alloys.

The room-temperature properties of further alloys are shown in Table 1. It was found that some of the test samples taken from the alloy containing 0.17% of copper showed quench cracking, rendering them useless. This alloy was again treated and tested under the same conditions but the heat treatment at 520° C. was preceded by a 16 hour heat treatment at 465° C. Quench cracking was again observed in some of the samples. Similar trials carried out with alloys containing 0.18% copper gave such intense quench cracking that the samples could not be tensile tested.

On the other hand, the alloy containing 0.12% of copper mentioned in Table 1 gave quench cracking and consequently very poor mechanical properties after simple heat treatment at 520° C. but gave satisfactory mechanical properties and no quench cracking when initially heat-treated at 465° C.

TABLE 1

| Analysis | | | | Heat Treatment | | | Tensile Prop. N/mm2 | | |
|---|---|---|---|---|---|---|---|---|---|
| Ag | RE | Zr | Cu | Solution | Quench | Age | 0.2% proof stress | UTS | Elong. 1% |
| 1.59 | 2.14 | 0.58 | — | 8 hrs 520° C. | HWQ | 16 hrs 200° C. | 181 | 241 | 4 |
| 1.54 | 2.14 | 0.58 | 0.10 | " | " | " | 188 | 250 | 4 |
| 1.51 | 2.07 | 0.60 | 0.17 | " | " | " | 187 | 270 | 5 |
| 1.67 | 1.99 | 0.50 | 0.12 | " | " | " | — | 164 | 0 |
| 1.59 | 2.14 | 0.58 | — | 16 hrs 465° C. + | 8 hrs 530° C. | | 185 | 252 | 4 |
| 1.65 | 1.94 | 0.53 | 0.06 | " | " | " | 199 | 267 | 7 |
| 1.70 | 2.53 | 0.52 | 0.08 | " | " | " | 205 | 261 | 4 |
| 1.67 | 1.99 | 0.50 | 0.12 | " | " | " | 187 | 252 | 6 |
| 1.69 | 1.84 | 0.55 | — | 8 hrs 520° C. | | " | 190 | 261 | 4 |
| 1.62 | 1.71 | 0.58 | 0.07 | " | | " | 195 | 260 | 4 |

The effect of copper addition on mechanical properties at a high temperature (250° C.) is shown in Table 2 together with room temperature results. It is seen that at both high and low temperatures the addition of copper to low-silver alloys gives properties as good as or even better than those of the high-silver alloys.

TABLE 2

| Analysis % | | | | Heat Treatment | | R.T. Tensiles | | | H.T. Tensiles at 250° C. | | |
|---|---|---|---|---|---|---|---|---|---|---|---|
| Ag | RE | Zr | Cu | Solution | Age | Yield $Nmm^{-2}$ | UTS $Nmm^{-2}$ | Elong. % | Yield $Nmm^{-2}$ | UTS $Nmm^{-2}$ | Elong. % |
| 2.7 | 2.2 | 0.53 | — | 8h 525° C. | 16h 200° C. | 213 | 278 | 4 | 134 | 164 | 19 |
| 1.04 | 1.77 | 0.57 | 0.08 | 16h 470° C. + 8h 520° C. | 16h 200° C. | 177 | 247 | 4 | 137 | 161 | 18 |
| 2.53 | 1.75 | 0.51 | — | 8h 520° C. | 16h 200° C. | 195 | 247 | 2 | 130 | 151 | 15 |
| | | | — | " | " | | | | | | |
| 1.62 | 1.71 | 0.58 | 0.07 | " | " | 195 | 260 | 4 | 148 | 162 | 13 |

The results of porosity tests are shown in Table 3 below:

TABLE 3

| Analysis % | | | | Radiographic Analysis of Porosity Plates | |
|---|---|---|---|---|---|
| Ag | RE | Zr | Cu | Unchilled | Chilled |
| 2.7 | 1.9 | 0.55 | — | Porous for 4" rating 7 | Very slight general rating 0 |
| 1.69 | 1.84 | 0.55 | — | Porous for 3½" rating 5 | None |
| 1.62 | 1.71 | 0.58 | 0.07 | Porous for 2½" rating 3 | None |

It can be seen from these results that the addition of Cu gives a marked improvement in unchilled porosity and some improvement in chilled porosity. The porosities are rated on an arbitrary scale, the value increasing with increasing porosity.

The results of corrosion tests are shown in Table 4 below. They show that the low silver alloys containing copper have a reduced corrosion rate. The invention thus provides alloys having mechanical properties as good as those already known but with a lower tendency to corrode.

TABLE 4

| Analysis % | | | | Corrosion Rate (mg/cm2/day) | Average Corrosion Rate (mg/cm2/day) |
|---|---|---|---|---|---|
| Ag | RE | Zr | Cu | | |
| 2.7 | 2.2 | 0.53 | — | 4.41<br>4.54 | 4.47 |
| 1.04 | 1.77 | 0.57 | 0.08 | 2.75<br>2.91 | 2.83 |

We claim:

1. A cast magnesium base alloy which when heat treated has a 0.2% proof stress of at least 175 $N/mm^2$ and an ultimate tensile strength of at least 240 $N/mm^2$ at ambient room temperature, consisting of the following other than iron and other impurities:

| | |
|---|---|
| Magnesium | at least 88% |
| Silver | from 1 to 2% by weight |
| Copper | from 0.05 to 0.15% by weight |
| Rare Earth Metals of | |

-continued

| | |
|---|---|
| which at least 60% by weight are Neodymium | from 0.5 to 3.0% by weight |
| Zirconium | nil to 1% by weight |
| Manganese | nil to 2% by weight |
| Zinc | nil to 0.5% by weight |
| Cadmium | nil to 1.0% by weight |
| Lithium | nil to 6.0% by weight |
| Calcium | nil to 0.8% by weight |
| Gallium | nil to 2.0% by weight |
| Indium | nil to 2.0% by weight |
| Thallium | nil to 5.0% by weight |
| Lead | nil to 1.0% by weight |
| Bismuth | nil to 1.0% by weight |

the maximum quantities of zirconium and manganese being limited by their mutual solubility in the alloy.

2. An alloy according to claim 1, containing from 1.0 to 1.75% by weight of silver.

3. An alloy according to claim 1 which contains at least 0.4% by weight of zirconium.

4. An alloy according to claim 1, in which the neodymium is added as a mixture of rare earth metals containing at least 60% by weight of neodymium and not more than 25% by weight of lanthanum and cerium taken together.

5. An alloy according to claim 1, containing up to 0.1% copper.

6. A cast magnesium base alloy product according to claim 1, obtained by holding the cast alloy at a temperature from 400° C. to 485° C. for at least one hour followed by holding at a temperature form 485° C. to the solidus of the alloy for at least 2 hours, then quenching and ageing the product at a temperature from 100° to 275° C. for at least half an hour.

7. A cast magnesium base alloy product according to claim 5, obtained by holding the cast alloy at a temperature from 485° C. to the solidus of the alloy for at least 2 hours and then quenching and ageing the product at a temperature from 100° C. to 275° C. for at least half an hour.

* * * * *